US008141279B2

(12) United States Patent
Jiang et al.

(10) Patent No.: US 8,141,279 B2
(45) Date of Patent: Mar. 27, 2012

(54) STEAM IRONING DEVICE, IRONING BOARD AND IRONING SYSTEM, WITH MEANS FOR PROVIDING AN ELECTRICALLY CHARGED STEAM OUTPUT

(75) Inventors: Yong Jiang, Singapore (SG); Vignesh Nathamuni Balaji, Singapore (SG); Boon Teck Tan, Johor Barhru (MY); Zhongming Ma, Singapore (SG); Seetharam Samba Subba Chigurupati, Singapore (SG); Job Jan Van Der Burg, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 644 days.

(21) Appl. No.: 11/722,456

(22) PCT Filed: Dec. 12, 2005

(86) PCT No.: PCT/IB2005/054351

§ 371 (c)(1),
(2), (4) Date: Oct. 2, 2009

(87) PCT Pub. No.: WO2006/067754

PCT Pub. Date: Jun. 29, 2006

(65) Prior Publication Data

US 2010/0011630 A1 Jan. 21, 2010

(30) Foreign Application Priority Data

Dec. 22, 2004 (EP) ..... 04106873
Jun. 15, 2005 (EP) ..... 05105273

(51) Int. Cl.
*D06F 75/20* (2006.01)
*D06F 75/08* (2006.01)

(52) U.S. Cl. ..... 38/77.9; 38/103

(58) Field of Classification Search ..... 38/74–77.9, 38/82, 85, 88, 93, 96, 97, 103–137, 144; 219/245

See application file for complete search history.

(56) References Cited

U.S. PATENT DOCUMENTS

| | | | | |
|---|---|---|---|---|
| 5,642,578 | A * | 7/1997 | Hazan et al. | 38/77.7 |
| 7,340,853 | B2 * | 3/2008 | Ching et al. | 38/77.5 |
| 2003/0066138 | A1 * | 4/2003 | France et al. | 8/147 |
| 2004/0154214 | A1 * | 8/2004 | Hughes et al. | 43/107 |
| 2006/0118132 | A1 * | 6/2006 | Bergman et al. | 134/1 |
| 2006/0191157 | A1 * | 8/2006 | Gerlach et al. | 34/329 |
| 2011/0000975 | A1 * | 1/2011 | Gartstein et al. | 239/3 |

FOREIGN PATENT DOCUMENTS

JP 2005224757 A * 8/2005

* cited by examiner

*Primary Examiner* — Ismael Izaguirre

(57) ABSTRACT

A steam ironing device (10) provides an ionized steam output using an ionizing arrangement (30). The ionization process, in particular the high energy electric discharge used for ionization, breaks down steam particles into finer particles. As a result, a greater proportion of the steam particles generated can penetrate into the fabric of the garment being ironed, to improve fabric treatment and fabric moistening. Air ionization can also be used. The ionization process is improved by limiting the temperature of the steam.

33 Claims, 4 Drawing Sheets

STEAM IRONING DEVICE, IRONING BOARD AND IRONING SYSTEM, WITH MEANS FOR PROVIDING AN ELECTRICALLY CHARGED STEAM OUTPUT

This invention relates to a steam ironing device, such as a steam iron with integrated water reservoir, a steam ironing system with separate steam boiler or integrated steam ironing system in which a boiler or steam generator is integrated with an ironing board.

Steam irons are a well-known domestic appliance.

A conventional steam iron comprises a soleplate heated by an electric heating element. The temperature of the soleplate is kept at a desired temperature by means of a thermostat and a temperature dial. Steam is generated by a steam generator, which comprises a water tank, a water-dosing pump, and a steam chamber. The water pump pumps water from the water tank to the steam chamber (as drips rather than a large flow of water) via a hose under command of a pump signal from an electric control device. The rate at which water is supplied dictates the amount of steam being produced, and the amount of steam is sufficiently low that the temperature of the sole plate is not significantly affected.

Instead of a pumped system, water can be dosed to the steam chamber under gravity.

The steam chamber is typically heated by the soleplate, but an auxiliary heating element may instead be provided.

The steam from the steam chamber reaches steam vents provided in the base of the sole plate.

The steam produced by steam irons serves to dampen the fabric to be ironed. The application of moisture to a garment during ironing makes the ironing process easier, and reduces the time taken. In particular, the weakness of some fibres increases with the water content, especially cotton, linen, viscose and wool. The application of moisture thus conditions the fabric for subsequent ironing. This ironing process is essentially a relaxation process by which the fibres recover from the plastic deformation caused by wearing of the clothing. An alternative to the application of steam is the use of a cold-water spray or pre-dampening of a garment before ironing.

The invention aims to improve the effectiveness of the steam iron.

According to an aspect of the invention, there is provided a steam ironing device comprising an iron with a sole plate for pressing against an article to be ironed, a water reservoir and steam generating means, wherein the ironing device further comprises means for providing an electrically charged steam output to the article being ironed.

The electrical charging of the steam output achieves the aim of the invention by providing smaller steam droplets as the formation of larger droplets is resisted by electrostatic forces. As a result, a greater proportion of the steam droplets generated can penetrate into the fabric of the garment being ironed. The finer steam also presents an increased steam droplet surface area, enabling a more rapid dissipation of heat. This allows an increased level of condensation for conditioning the fabric.

Preferably, the electric charging is achieved using an ionization arrangement. It has been found that the ionization process, in particular the high energy electric discharge used for ionization, can also break down steam droplets into finer droplets, with the benefits outlined above.

The invention additionally is based on the recognition that the effectiveness of the ionization process is temperature dependent, and is more effective at lower temperatures, and these lower temperatures may be below the normal steam temperature. Thus in one aspect, the invention further aims to reduce the temperature of the ionized steam.

Preferably, the temperature of the steam output is less than 160 degrees Celsius for all temperature settings of the device.

By ensuring the steam output has a low temperature of less than 160 degrees, the ionization to provide the electrically charged output is more effective.

The steam generating means preferably comprises a chamber, and saturated steam is provided as the steam output. This provides one mechanism for obtaining a steam temperature of below 160 degrees.

Even more preferably, the temperature of the steam output is between 100 and 150 degrees Celsius for any temperature setting of the device.

The steam generating means may comprise a chamber having a water dosing input from the water reservoir, and the water dosing input can be arranged to be adjacent a steam output from the steam generating means. By providing the steam output from part of the steam chamber in the vicinity of the water dosing input, this provides one way of obtaining low temperature (i.e. less than 160 degrees Celsius) saturated steam as the steam output. In particular, the steam generated in the vicinity of the water supply (preferably from a cold water reservoir) to the steam chamber will be saturated steam.

Instead, a steam output from the steam generating means can be coupled to an area adjacent the water dosing input by steam passageways. This again means that the steam routed to the steam output originates from the vicinity of the water dosing input, which is the area within the steam chamber where saturated steam will be present.

These steam passageways are then preferably arranged to pass near lower temperature zones of the iron sole plate. This reduces to a minimum the heating of the steam as it passes from the vicinity of the water dosing input to the steam output.

Steam can be provided to a steam output from the steam generating means by steam passageways which themselves provide cooling, for example if they are formed from thermally insulating material. The steam passageways may for example extend to the outside of the sole plate. This enables the steam temperature to be reduced compared to the temperature within the steam chamber.

The means for providing an electrically charged output may also comprise means for providing ionized air. This can be applied directly to the garment or mixed with steam.

The iron preferably comprises a steam chamber having steam outlet nozzles, and an electrode arrangement is provided within the steam chamber.

For example, the electrode arrangement may comprise at least two electrodes to which different voltages are applied. These then provide a field which induces ionization. The electrode arrangement may instead comprise at least two electrodes to which a first voltage is applied, and the steam chamber can define a further ground electrode. The water molecules in the vicinity of the electrodes are then charged to the same polarity.

For example, substantially only negative negatively charged water droplets may be provided in the stream output. It has been found that fabric tends to be positively charged, and the generation of negatively charged steam droplets takes advantage of this by allowing electrostatic attraction of the steam droplets to the fabric. This makes the use of the generated steam more efficient.

The same heater arrangement may be used for generating the steam as for the sole plate, or else different heating arrangements may be used.

Embodiments of the steam ironing device according to the invention are defined in the claims 2 to 28.

The invention also provides a steam ironing system comprising:

an iron with a sole plate for pressing against an article to be ironed; an ironing board;

a water reservoir and steam generating means; and means for providing an electrically charged steam output to the article being ironed.

The system according to the invention uses the steam charging as explained above in a system including an ironing board. The steam generating means may be part of the board or part of the iron.

Embodiments of the steam ironing system according to the invention are defined in claims 30 to 32.

The invention also provides an ironing method comprising applying electrically charged steam to a garment during ironing, the steam having a temperature of less than 160 degrees Celsius.

Examples of the invention will now be described in detail with reference to the accompanying drawings, in which:

FIG. 1 shows a first example of iron in accordance with the invention.

Figure 1:
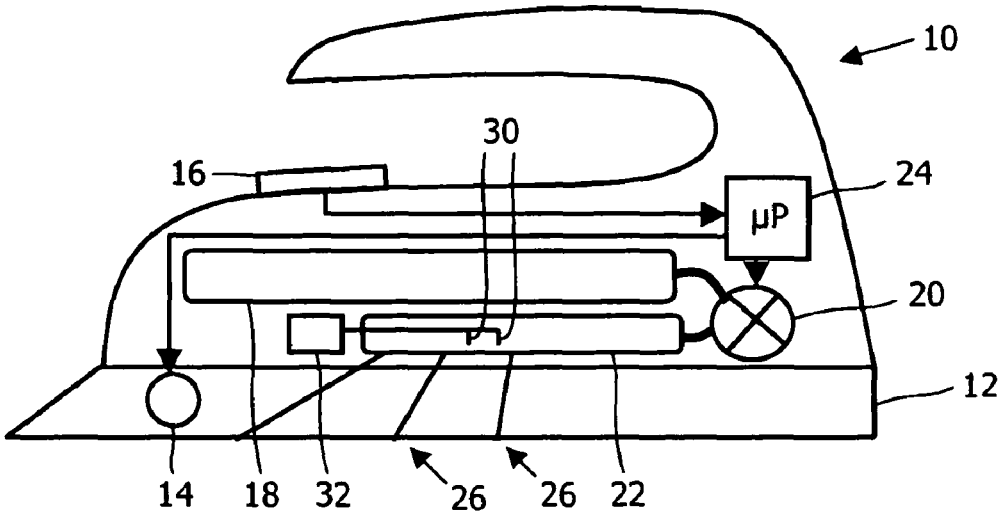
FIG. 1 shows a first example of steam iron in accordance with the invention.

The iron comprises a metal soleplate 12 heated by an electric heating element 14. The temperature of the soleplate is kept at a desired temperature by means of a thermostat and a temperature dial 16. Steam is generated by a steam generator, which comprises a water tank 18, a water-dosing pump 20, and a steam chamber 22. The water pump 20 pumps water from the water tank 18 to the steam chamber 22 via a hose under command of a pump signal from a control processor 24.

In the example shown, the steam chamber 22 is heated by the soleplate 12 (and may in practice be part of the soleplate), but an auxiliary heating element may instead be provided so that the water chamber 18 can be implemented as a separate boiler.

The steam from the steam chamber is routed to steam vents 26 in the base of the sole plate.

The iron of the invention is conventional to the extent described above.

In accordance with the invention, the steam iron is provided with means for charging the steam output. In FIG. 1, this charging means comprises ionization electrodes 30 powered by an appropriate power source 32, and provided within the steam chamber 22. These electrodes induce high energy electric discharge within the steam formed in the steam chamber.

The ionization process breaks down the steam into finer droplets. As a result, a greater proportion of the steam droplets generated can penetrate into the fabric of the garment being ironed. This provides improved penetration of the droplets into the fabric and also gives an increase in condensation rate.

The ionization process charges the water molecules, and it may also ionize the surrounding air. The resulting charged steam resists formation of large droplets as a result of electric repulsion, both in transit and during deposition, and the droplet size is also more uniform.

The use of ionization has been proposed in various domestic appliance applications, for different reasons, and the use of ionization within a steam iron also provides corresponding subsidiary benefits.

For example, the use of air ionization systems have been proposed in order to provide anti-bacterial and deodorizing properties. Negative ions in particular have been found to posses these properties.

For a steam iron, the use of ionization can therefore also provide deodorizing benefits both for the garment being ironed and for the surrounding air, which is of course in the vicinity of the user of the iron. The combination of air and steam ionization thus conditions the garment, removes odour, refreshes the garment and the environment around the iron, and prevent mould formation.

The charged steam flow also serves to reduce fabric static electricity.

A further benefit is that ions resulting from the ionization process can be electrostatically attracted to the garment. It has been found that fabric tends to be positively charged (by a process of giving up surface electrons). This tendency to give up surface electrons is dependent on the dampness of the fabric, but in all cases, the generation of negative ions takes advantage of this by allowing electrostatic attraction of the ionized steam to the fabric.

The ionization can be achieved in conventional manner. Essentially, a pair of electrodes disposed closely adjacent between a high frequency alternating field is applied will produce high corona discharge energy. The energy of a high energy corona discharge can reduce droplet size, and the emitters in an ac system will emit positive and negative ions alternately. Alternatively, a dc ionizer may be used and can emit one ion charge only.

Figure 2:
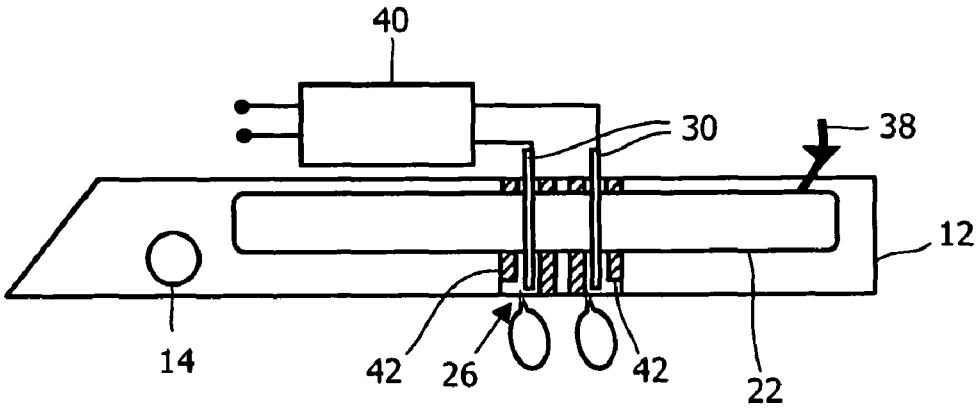
FIG. 2 shows in more detail the steam chamber of the iron of FIG. 1.
Figure 3:
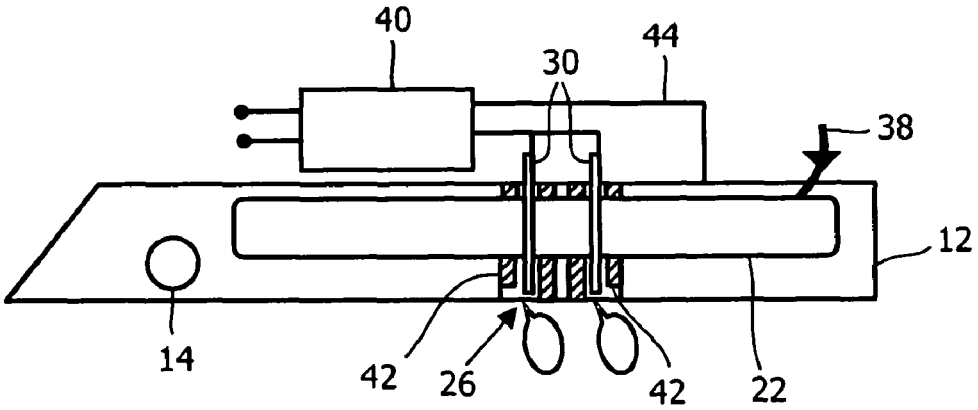
FIG. 3 shows a second example of steam iron in accordance with the invention.
Figure 4:
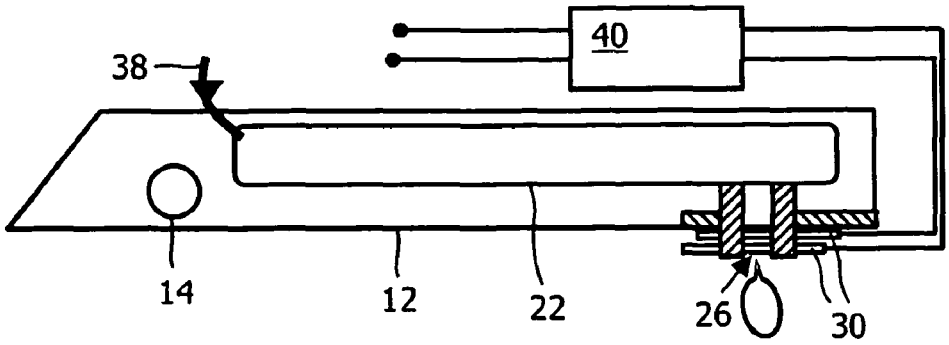
FIG. 4 shows a third example of steam iron in accordance with the invention.

FIGS. 2 to 4 show in more detail possible implementations of the invention. In each case, the sole plate 12 is shown, and the steam chamber 22 is integral with the sole plate and heated by the sole plate heater 14. The water supply to the steam chamber is shown schematically as 38

In FIG. 2, the electrodes 30 of the ionizer 40 extend through the steam chamber, with insulating inserts 42 isolating the electrodes 30 from the sole plate metal. Each electrode 30 extends into the nozzle opening 26, and thereby provides charging of the steam exiting the nozzle.

In FIG. 3, the electrodes 30 are of the same polarity, and the other electrode is defined by the sole plate itself, which is at ground potential. Thus, one of the output terminals 44 of the ionizer 40 is ground.

In FIG. 4, instead of the ionizer electrodes being provided in the steam chamber, they are provided at the nozzle outputs 26.

Figure 5A:
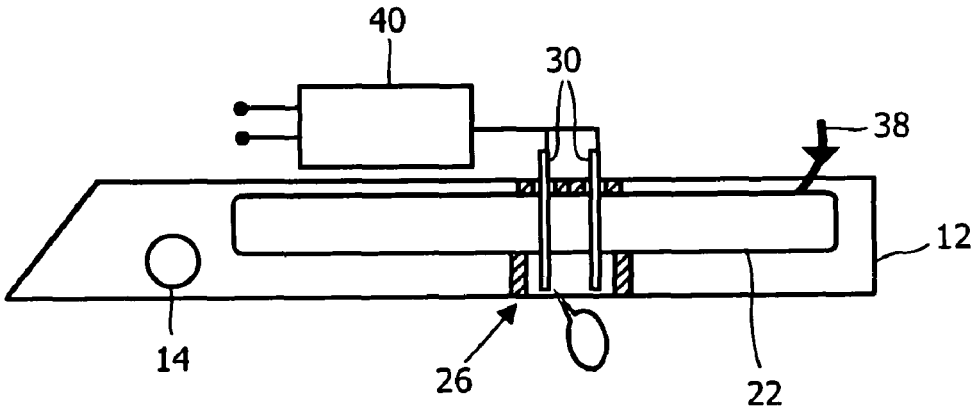
FIGS. 5A and 5B shows two versions of a fourth example of steam iron in accordance with the invention.
Figure 5B:
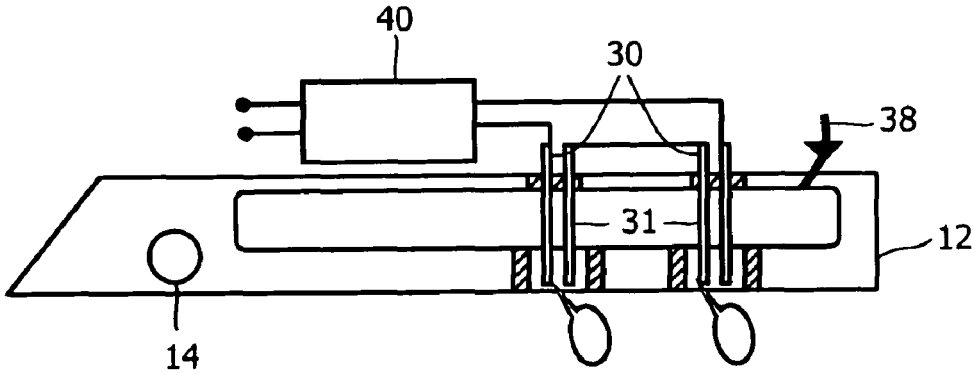

Further variations are shown in FIGS. 5A and 5B, in which the ionizer electrodes are again provided at a single output nozzle of the steam chamber (FIG. 5A) or at multiple output nozzles (FIG. 5B). In FIG. 5B, a conductive wire 31 extends between the two electrodes 30 effectively so as to define two pairs of electrodes, each within an output nozzle of the steam chamber. The electrodes spark against the conductive wire adjacent to them.

The operation of the ironing device described above can be improved if the temperature of the steam can be kept as low as possible. Typically, the steam output of a steam iron on full temperature setting is in the range 180 degrees Celsius to 200 degrees Celsius. The full temperature setting of an iron typically corresponds to a sole plate temperature in the range 200 to 220 degrees Celsius, giving rise to the range of steam temperatures of 180 to 200 degrees Celsius. Thus, in the conventional steam iron, the steam will be in a temperature range from 100 degrees Celsius to 180-200 degrees Celsius depending on the iron design and the temperature setting.

An improvement to the designs outlined above is to reduce this steam temperature range, for example to provide a maximum steam temperature of 160 degrees Celsius or lower, and more preferably providing steam in the temperature range 100 to 150 degrees Celsius (again depending on the temperature setting), and various approaches with this aim are described below. In particular, even with a sole plate temperature as high as 220 degrees Celsius, the invention recognizes the benefit in keeping the steam temperature below 160 degrees Celsius, in particular to improve the beneficial effects of the ionized steam.

Figure 6:
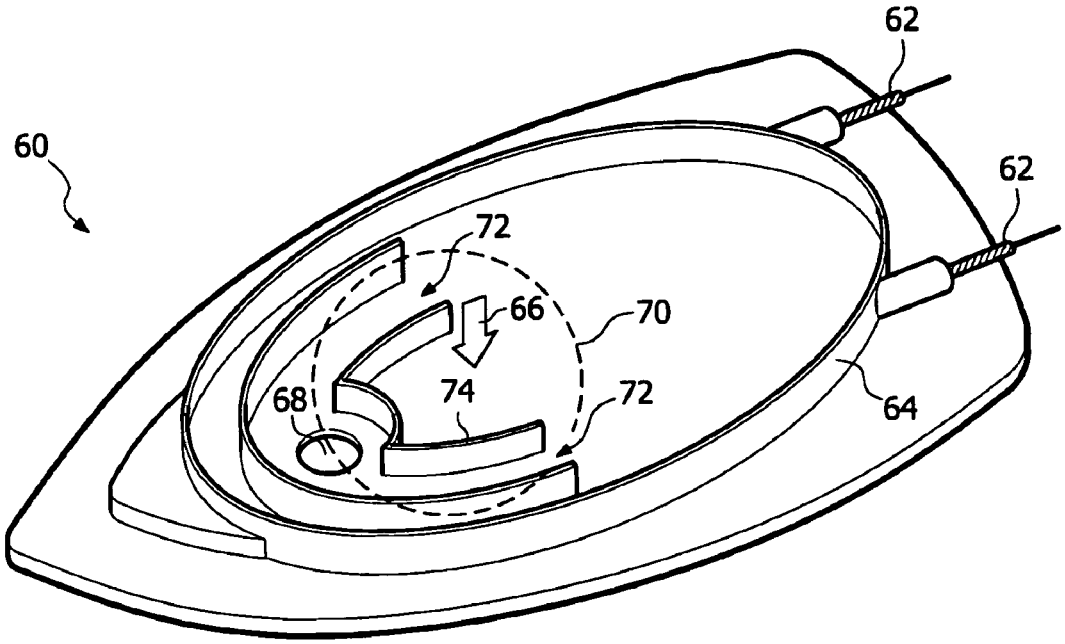
FIG. 6 shows an example of sole plate for an embodiment of steam iron of the invention.

FIG. 6 shows schematically an iron sole plate which is formed to define the steam chamber. The sole plate 60 has a flat base surface and incorporates a heating element, only the terminals 62 of which are shown. The steam chamber is defined by a raised wall 64, and a water dosing input supplies water to the steam chamber. This water dosing input provides water to the location represented as 66. For simplicity, the steam output is shown as a single orifice 68, but this be arranged as or may lead to an array of openings in the underside of the sole plate.

The steam temperature within the chamber is not uniform, and depends on temperature variations across the sole plate, and also on the water temperature and location of the water dosing input. In practice, a region 70 will exist where the steam is saturated and therefore at a lower temperature.

"Overheated" or "dry" steam is steam at a temperature higher than the temperature of saturation. "Saturated" or "wet" steam is steam at the temperature of the boiling point which corresponds to its pressure. The initial formation of steam will take place when the water from the water dosing input reaches this boiling point. Thus, the steam in the chamber in the vicinity of the water dosing input will be saturated and at or near this boiling point (which depends on the pressure in the steam chamber). As the steam flows within the steam chamber, the temperature rises, particularly if the soleplate temperature is set at a high temperature. Thus, the use of steam from the vicinity of the water dosing input enables the temperature of the steam to be lower than the steam temperature which may be present in other parts of the steam chamber.

In the design shown schematically in FIG. 6, the steam passes to the output 68 along passageways 72, and a wall 74 blocks direct connection between the water dosing input and the output, and prevents water in the chamber flowing to the output.

In an alternative arrangement, a wall in the form of a column may be provided upstanding from the output 68, again to prevent spitting from the output 68.

In FIG. 6, the water dosing input is adjacent the steam output from the steam generating means to enable saturated steam to be provided as the output. Steam passageways 72 are provided to direct the steam to the output, but in the example of FIG. 6, the dosing input, the output and the passageways are all in a saturated steam zone.

As the steam travels along the passageways, it will heat up, and therefore the passageways should therefore be as short as possible. However, the temperature of the soleplate close to the saturated steam zone is typically lower than regions further from that zone, and using passageways which follow a path through this zone minimizes heating and enables the steam output to be some distance away from the dosing input, while still providing low temperature steam.

An alternative approach to enable greater flexibility in the positional design of the components is to use passageways designed to provide some cooling.

Materials with high thermal insulation properties, for example rubber tubes, can be used within the sole plate to prevent the coupling of heat from the soleplate to the steam. Taking this further, these passageways may extend outside the soleplate to provide cooling. With the steam contained within an external passageway, additional cooling mechanisms can be employed such as fans or heat sinks. The steam can subsequently be released directly from outside of the steam iron or directed back to the soleplate before being released via the soleplate.

Figure 7:
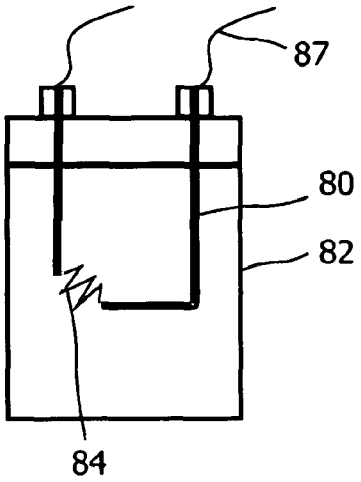
FIG. 7 shows a design of ionization chamber of the invention.

The ionization may be carried out in a separate chamber as shown in FIG. 7, which shows the chamber 82 housing the electrode pins 80. The desired arcing is shown as 84. The chamber is electrically insulated, to prevent sparking to the soleplate, and may for example be made from rubber, plastic or ceramic. The wires to the ionizer electrode pins are shown as 87.

To enhance the effectiveness for electromagnetic compatibility (EMC), the chamber can be surrounded or partially surrounded by a grounded electrically conducting material, serving as an EMC shield.

An electrically conductive material can also be used to wrap around the wires 87 connecting to the ionizing electrodes. With these conductors connected to ground, an EMC shield is formed. The electrode pins 80 can be insert moulded with the ionization chamber to simplify the assembly process and provide good sealing.

Figure 8:
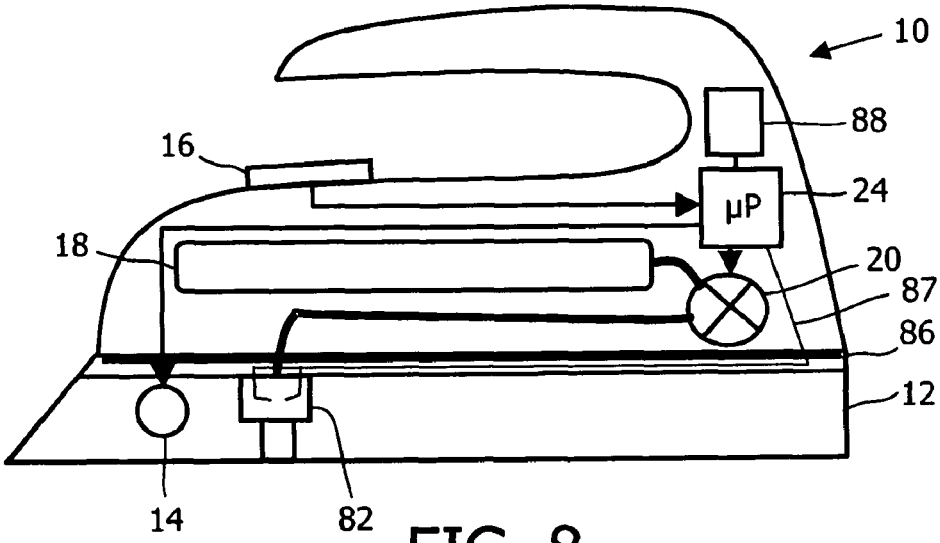
FIG. 8 shows another embodiment of steam iron of the invention using a shielding plate.

An example of this EMC shielding is shown in FIG. 8, in which a metal plate 86 is provided above the ionizer wires 87 and the ionizer chamber 82. In this example, the steam chamber is formed by the sole plate 12, in the manner explained with reference to FIG. 6. The ionization chamber 82 is able to receive steam from the steam chamber for ionization. The metal plate 86 can also function as a heat shield between the sole plate and the main body of the iron.

A further improvement is to provide steam ionization only when the iron is in use. This reduces wasted power consumption. This can be achieved using a position/orientation sensor, shown as 88 in FIG. 8. This is used to sense a horizontal orientation. This position sensor can be in the form of a switch and may be electrical or mechanical. With the iron in the horizontal position, the switch is closed to allow power supply to the ionization electrodes, and with the iron sufficiently far from the horizontal, the power is interrupted. The same function may be achieved by a switch which is depressed when the iron is stood in its upright position, and this switch depression deactivates the ionization function.

There are of course may ways to implement this cut-off function.

A dc supply for the ionizer can be obtained by using a simple rectifier circuit, for example a voltage regulator in the form of a zener diode and resistors, and a rectifier diode. The position sensitive switch can then form part of the ac to dc converter circuit, for example the switch can be a relay, triac and/or thyristor which is in the path of the current supply to the ionizer device. Alternatively, an ac ionizer can be used.

A visual or audio indicator can be used to indicate when the ionizer is active.

As mentioned above, the ionization process can provide charged steam droplets and ionized air. Steam ionization can be achieved most effectively using an ac ionizer. This is because the efficiency of dc ionizers can drop in the presence of moisture around the dc emitter.

For air ionization, a dc ionizer is most commonly used in existing air ionization technology. Negative ions from the ionization of air have been found to have anti-bacterial and deodorizing properties.

In the examples above, the steam chamber is heated by the sole plate. It is equally possible for a separately powered steam generator to enable completely independent control of the sole plate heating function and the steam generation function.

As mentioned above, ionization can be induced by an alternating current field or a direct current field. A large negative voltage applied to the electrodes can provide the generation of negative ions, which are associated with the deodorizing properties and reduction in particulate impurities. The implementation of the ionizing function, in particular the required electrode designs and voltage drive schemes, will be routine to those skilled in the art.

There may be additional functions implemented by the processor 24, but these additional functions are not relevant to this invention, and for this reason, only an overview of the operation the steam iron has been given. The invention can be applied to all types of known steam irons, and accordingly many different variations will be apparent to those skilled in the art.

The detailed examples given all relate to a steam iron in which the water reservoir and steam generation is internal to the iron. There are other types of ironing device to which the invention can be applied, and which are intended to be within the scope of this application.

Steam ironing "systems" are known, in which a separate external steam boiler is provided. This boiler can be mounted on a stand, and steam is supplied from the boiler to the iron by a connecting steam hose. The steam hose can also provide the electric power lines to the iron. In this case, the ionization can be provided in the iron itself or in the external boiler. The boiler in the stand may have a separate water reservoir for feeding water to the boiler as needed. Instead of an external boiler, the steam generation may be in the iron, and only an external water reservoir is provided in the iron stand. In this case, a pump feeds the water from the water reservoir into the iron, and the water hose can again provide the electric power lines to the iron.

Ironing system are also known in which the external boiler or steam generator is integrated with an ironing board. The ironing board may be provided with additional functions, such as heating for the board and a fan.

Figure 9:
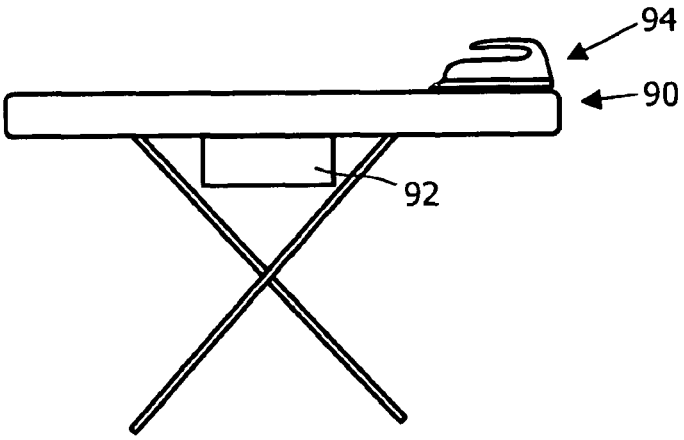
FIG. 9 shows an ironing system of the invention, in which the steam generation is integrated into an ironing board.

FIG. 9 shows an ironing system comprising a board 90 which is provided with the ionized steam generation system 92 and an iron 94. The steam generation system can deliver steam to the iron for subsequent application to the article being ironed, or else the steam generation system 92 can apply the steam directly to the article being ironed.

The water supply to the steam chamber can be pumped or under gravity.

Figure 10:
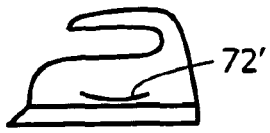
FIG. 10 shows a further embodiment of steam iron of the invention using external cooling passageways.

For completeness, FIG. 10 shows a steam iron of the invention in which an external cooling passageway 72' is provided for cooling the ionized steam before it is delivered to the clothing being ironed.

In the examples above, the iron sole plate is heated. However, it is possible for the heating to be carried out separately (including heating by means of the applied steam), and the iron sole plate is then purely for pressing.

The examples above each use an ionization arrangement to charge the steam output and also to provide finer steam droplets.

Various techniques are described above for maintaining steam at a low temperature. Additional measures may be employed, for example using materials of different thermal properties for different parts of the sole plate. This can be used to define lower and higher temperature regions within the steam chamber.

Various other modifications will be apparent to those skilled in the art.

The invention claimed is:

1. A steam ironing device comprising an iron with a sole plate for pressing against an article to be ironed, a water reservoir and steam generating means, wherein the ironing device further comprises means for providing an electrically charged steam output to the article being ironed.

2. A steam ironing device as claimed in claim 1, wherein the temperature of the steam output is less than 160 degrees Celsius for all temperature settings of the device.

3. A steam ironing device as claimed in claim 1, wherein the temperature of the steam output is between 100 and 150 degrees Celsius for any temperature setting of the device.

4. A device as claimed in claim 1, wherein the steam generating means comprises a chamber and wherein saturated steam is provided as the steam output.

5. A device as claimed in claim 1, wherein the steam generating means comprises a chamber having a water dosing input from the water reservoir, and wherein the water dosing input is adjacent a steam output from the steam generating means.

6. A device as claimed in claim 5, wherein steam output is partially or fully surrounded by a wall.

7. A device as claimed in claim 1, wherein the steam generating means comprises a chamber having a water dosing input from the water reservoir, and wherein a steam output from the steam generating means is coupled to art area adjacent the water dosing input by steam passageways.

8. A device as claimed in claim 1, wherein the steam generating means comprises a chamber having a water dosing input from the water reservoir, and wherein steam is provided to a steam output from the steam generating means by steam passageways.

9. A device as claimed in claim 8, wherein the steam passageways extend between the region of the water dosing input and the steam output.

10. A device as claimed in claim 8, wherein the steam passageways are formed from thermally insulating material.

11. A device as claimed in claim 8, wherein the steam passageways extend to the outside of the sole plate.

12. A device as claimed in claim 1, wherein the sole plate is heated.

13. A device as claimed in claim 1, wherein the means for providing an electrically charged output comprises an electrode arrangement arranged for charging the steam.

14. A device as claimed in claim 13, wherein the electrode arrangement is housed in an electrically insulating chamber.

15. A device as claimed in claim 14, wherein the electrodes of the electrode arrangement are insert moulded into the chamber.

16. A device as claimed in claim 14, wherein the chamber is at least partially surrounded by an electrically conducting member.

17. A device as claimed in claim 16, wherein the electrically conducting member comprises a ground plane.

18. A device as claimed in claim 17, wherein the electrical connections to the electrode arrangement are partially or fully surrounded by the electrically conducting member.

19. A device as claimed in claim 16, wherein the electrically conducting member is insert moulded with the chamber.

20. A device as claimed in claim 1, comprising a soleplate having steam outlet nozzles, and wherein the means for providing an electrically charged output comprises an electrode arrangement within the steam chamber.

21. A device as claimed in claim 20, wherein the electrode arrangement comprises at least two electrodes to which different voltages are applied.

22. A device as claimed in claim 20, wherein the electrode arrangement comprises at least two electrodes to which a first voltage is applied, and wherein the soleplate defines a further ground electrode.

23. A device as claimed in claim 1, wherein the means for providing an ionized output provides negative ions.

24. A device as claimed in claim 1, wherein the water reservoir, the steam generating means and the means for providing an electrically charged steam output to the article being ironed are provided in the iron.

25. A device as claimed in claim 1, wherein a heater arrangement is provided for heating the sole plate, and the steam chamber is heated by the same heater arrangement as the sole plate.

26. A device as claimed in claim 1, further comprising a sensor for detecting an orientation of the device, and wherein the sensor output is used to control the electrical steam charging.

27. A device as claimed in claim 26, wherein the sensor detects whether or not the device is in an operative ironing position and then enables the electrical steam charging.

28. A device as claimed in claim 27, wherein audio or visual feedback is provided to indicate the operation of the electrical steam charging.

29. A steam ironing system comprising:

an iron with a sole plate for pressing against an article to be ironed;

an ironing board;

a water reservoir and steam generating means; and means for providing an electrically charged steam output to the article being ironed.

30. A system as claimed in claim 29, wherein the means for providing an electrically charged steam output provides steam at a temperature in the range 100 to 160 degrees Celsius for all temperature settings of the iron.

31. A steam ironing system as claimed in claim 29, wherein the steam generating means forms part of the iron.

32. A steam ironing system as claimed in claim 29, wherein the steam generating means forms part of the ironing board.

33. An ironing method comprising applying electrically charged steam at a temperature of less than 160 degrees Celsius to a garment during ironing, the ironing comprising applying pressure to the garment using an iron sole plate.

* * * * *